US010306977B2

(12) United States Patent
Wong

(10) Patent No.: US 10,306,977 B2
(45) Date of Patent: Jun. 4, 2019

(54) HEIGHT ADJUSTABLE DESK

(71) Applicant: Tsang Wing Wong, Kowloon (HK)

(72) Inventor: Tsang Wing Wong, Kowloon (HK)

( * ) Notice: Subject to any disclaimer, the term of this patent is extended or adjusted under 35 U.S.C. 154(b) by 0 days.

(21) Appl. No.: 15/784,186

(22) Filed: Oct. 16, 2017

(65) Prior Publication Data

US 2019/0110588 A1 Apr. 18, 2019

(51) Int. Cl.

*A47B 9/16* (2006.01)
*A47B 21/03* (2006.01)
*A47B 21/02* (2006.01)

(52) U.S. Cl.

CPC ..... *A47B 9/16* (2013.01); *A47B 21/02* (2013.01); *A47B 21/0314* (2013.01); *A47B 2021/0335* (2013.01)

(58) Field of Classification Search

CPC ..... A47B 1/03; A47B 21/0314; A47B 21/00; A47B 21/02; A47B 21/03; A47B 9/16; A47B 2021/0321; A47B 2021/0364; A47B 3/02; A47B 3/0809; A47B 3/0815; A47B 2003/025; A47B 19/08; A47B 83/02; A47B 23/001; A47B 1/056; A47B 1/04; A47B 1/02; A47B 3/12; A47B 3/06; A47B 87/002; A47B 12/088; F16M 11/24; F16M 11/2014; F16M 11/2092; F16M 11/38

USPC ..... 312/208.1, 223.3, 306, 312, 194–196; 108/144.11, 145, 147, 93, 96, 116–118, 108/120, 43, 138, 50.01, 50.02, 14, 13, 108/11, 4, 9, 10, 33, 39, 146

See application file for complete search history.

(56) References Cited

U.S. PATENT DOCUMENTS 3,174,443 A * 3/1965 Rothenbuhler ..... A47B 3/02 108/117
4,712,653 A * 12/1987 Franklin ..... B66F 7/08 108/145
5,222,717 A * 6/1993 Traficant ..... B66F 7/065 254/122
5,722,513 A * 3/1998 Rowan ..... B65G 1/07 187/211

(Continued)

FOREIGN PATENT DOCUMENTS

DE 202016102015 * 3/2016
WO 2017045506 * 3/2017
WO 2018032792 * 2/2018

OTHER PUBLICATIONS

CN 206982621; Li T; abstract and figure (Year: 2017).*
CN 107048694; Dai N et al ; abstract and figure (Year: 2017).*

*Primary Examiner* — Janet M Wilkens

(57) ABSTRACT

A height adjustable desk including a desktop which engages with a pair of base supports by a pair of X-shaped frames and is adjustable between a fully raised position and a fully lowered position. The pair of X-shaped frames each has a first arm and a second arm. The pair of base supports each has a first biasing member which is configured to bias the corresponding second arm upwards to move the desktop towards the fully raised position, and a second biasing member which is configured to bias the corresponding first arm upwards to move the desktop towards the fully raised position. A pair of height adjustment members is provided on an underside of the desktop, each of which includes a handle, a guiding member, a connecting piece connected to the handle via a linkage mechanism and a biasing member.

9 Claims, 7 Drawing Sheets

(56) References Cited

U.S. PATENT DOCUMENTS

| | | | | |
|---|---|---|---|---|
| 7,246,784 | B1 * | 7/2007 | Lopez | A47B 51/00 108/145 |
| 8,439,334 | B2 * | 5/2013 | Deml | B60N 2/502 248/588 |
| 9,326,598 | B1 * | 5/2016 | West | A47B 3/02 |
| 9,480,332 | B2 * | 11/2016 | Han | A47B 9/02 |
| 9,681,746 | B1 * | 6/2017 | Chen | A47B 9/02 |
| 2013/0145972 | A1 * | 6/2013 | Knox | B60N 3/063 108/145 |
| 2015/0289641 | A1 * | 10/2015 | Ergun | A47B 9/16 108/42 |
| 2016/0249737 | A1 * | 9/2016 | Han | A47B 9/02 108/145 |
| 2018/0213929 | A1 * | 8/2018 | Ergun | A47B 9/16 |

* cited by examiner

HEIGHT ADJUSTABLE DESK

BACKGROUND OF THE INVENTION

The present invention relates to a desk and more specifically pertains to a height adjustable desk.

Height adjustable desks are widely available in the marketplace. To reduce the force required by users to lift up the desktop when adjusting the height of the desk, hydraulic cylinders are commonly used. However, such height adjustable desks have more complicated structure, and are therefore less economical to manufacture.

BRIEF SUMMARY OF THE INVENTION

In view of the aforesaid disadvantages now present in the prior art, the object of the present invention is to provide a height adjustable desk which are simple in structure, easy to manufacture and assemble and low in costs. The present invention is capable of reducing the force required by the user to lift up the desktop, and also provides a convenient means for user to adjust the desktop 1 to various heights.

To attain this, the height adjustable desk of the present invention comprises a desktop which engages with a pair of base supports by a pair of X-shaped frames and is adjustable between a fully raised position and a fully lowered position. The pair of X-shaped frames each comprises a first arm and a second arm; the first arm has a first top end and a first bottom end, wherein the first top end is pivotally connected to a top front pivot point fixedly connected to the desktop, and the first bottom end is pivotally connected to a bottom rear pivot point movably connected to the corresponding base support; the second arm has a second top end and a second bottom end, wherein the second top end is pivotally connected to a top rear pivot point movably connected to the desktop, and the second bottom end is pivotally connected to a bottom front pivot point fixedly connected to the corresponding base support. The pair of base supports each comprises a first biasing means and a second biasing means. The first biasing means has a first end which engages the second bottom end of the corresponding second arm and a second end which engages a front end of the corresponding base support; the first biasing means is configured to bias the corresponding second arm upwards to move the desktop towards the fully raised position. The second biasing means has a first end which engages the first bottom end of the corresponding first arm and a second end which engages the corresponding base support; the second biasing means is configured to bias the corresponding first arm upwards to move the desktop towards the fully raised position.

In one embodiment, each of the first biasing means is in form of a torsion spring with a first leg engaging the second bottom end of the corresponding second arm and a second leg abutting against an inner side of the corresponding base support.

In one embodiment, each of the second biasing means is in form of a coil spring with the second end thereof engaging the corresponding base support at a position near the front end of the corresponding base support. In other embodiments, each of the second biasing means may also be in form of a gas spring with the second end thereof engaging the corresponding base support at a position near a rear end of the corresponding base support.

In one embodiment, a first lower bracket is provided at a lower end of each of the first arms and slides along a lower guide rail extending along the corresponding base support; each of the first lower brackets has an upper portion and a lower portion; the first bottom end of the corresponding first arm is pivotally connected to the corresponding upper portion at the corresponding bottom rear pivot point; the lower portion is provided with a protrusion by which the first end of the corresponding second biasing means engages the first bottom end of the corresponding first arm.

In one embodiment, a pair of height adjustment means is provided on an underside of the desktop, each of which comprises a handle, a guiding member, a connecting piece and a biasing member. The handle is rotatable between an upward position and a downward position. The guiding member is provided with a plurality of slots and fixedly connected to the corresponding top rear pivot point and is movable in relation to the desktop along an upper guide rail as the desktop is moved between the fully raised position and the fully lowered position. The connecting piece is connected to the handle via a linkage mechanism so that rotation of the handle to the upward position moves the connecting piece to an unlocking position and rotation of the handle to the downward position moves the connecting piece to a locking position; the connecting piece is provided with a laterally extended tab portion which is configured to fit into any of the plurality of slots of the guide member in the locking position so as to fix the position of the desktop in relation to the pair of base supports. The biasing member biases the connecting piece towards the locking position.

In one embodiment, each of the linkage mechanism comprises a rotating rod, a first linkage member and a second linkage arm. The rotating rod has a first end rotatably connected to the corresponding handle. The first linkage member has a first end which is rotatable by a second end of the rotating rod. The second linkage arm has a first end which is pivotably connected to a second end of the first linkage member and a second end which is pivotably connected to the corresponding connecting piece. Simultaneous rotation of the handles to the upward position drives rotation of the first linkage members around the rotating rods along a first direction and thereby rotates the first ends of the second linkage arms from a vertical position to a horizontal position; the second ends of the second linkage arms are thereby driven to move downwards and causes the connecting pieces to overcome biasing force exerted by the biasing members to move downward to the unlocking position In one embodiment, each of the biasing members is in form of a spring with a first end abutting against the underside of the desktop and a second end abutting against the corresponding connecting member.

In one embodiment, each of the top front pivot points is fixedly connected to the desktop via a first upper bracket; each of the bottom rear pivot points is movably connected to the corresponding base support via the first lower bracket; each of the top rear pivot points is movably connected to the desktop via a second upper bracket; each of the bottom front pivot points is fixedly connected to the corresponding base support via a second lower bracket.

DETAILED DESCRIPTION OF THE INVENTION

Figure 1:
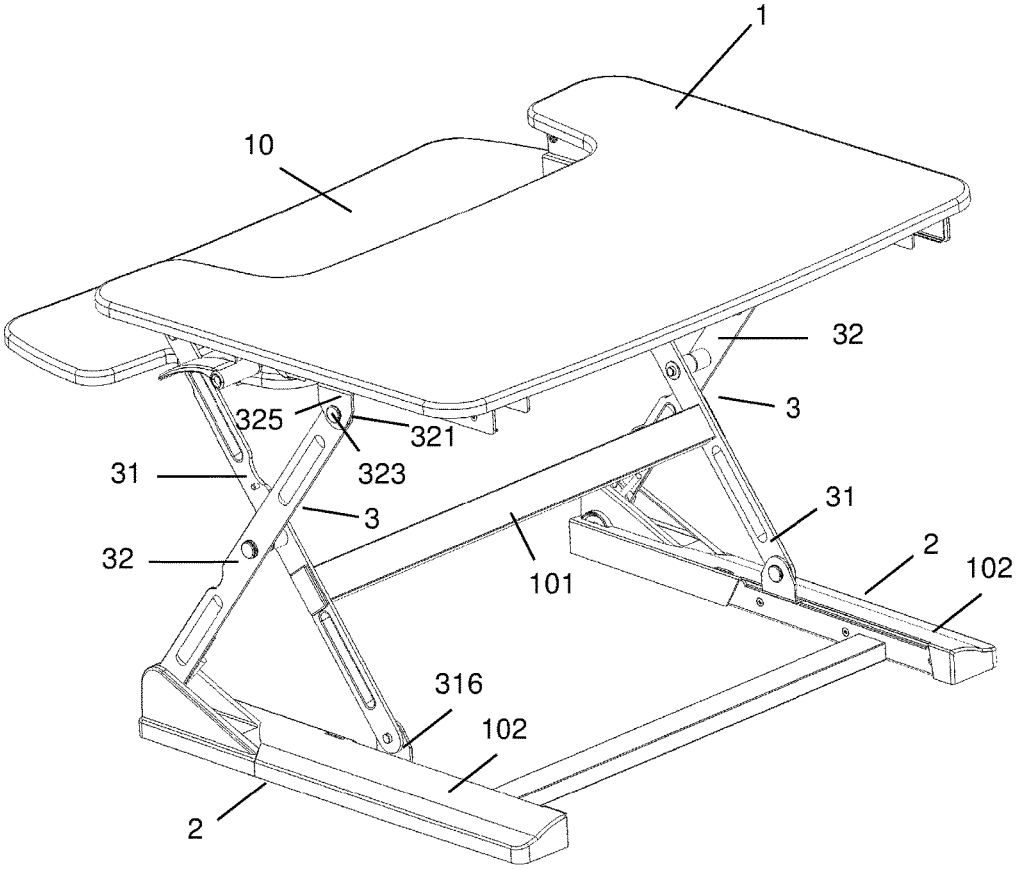
FIG. 1 is a perspective view of a preferred embodiment of the present invention.
Figure 2:
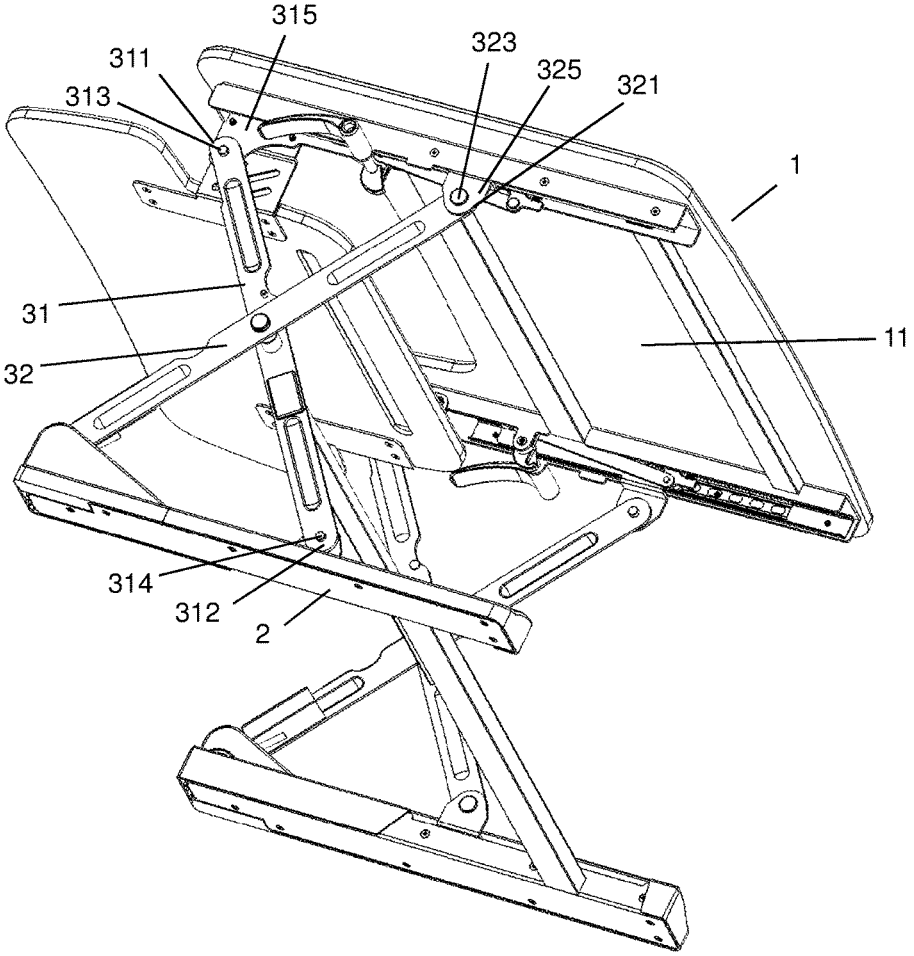
FIG. 2 is another perspective view of the preferred embodiment as shown in FIG. 1.
Figure 3:
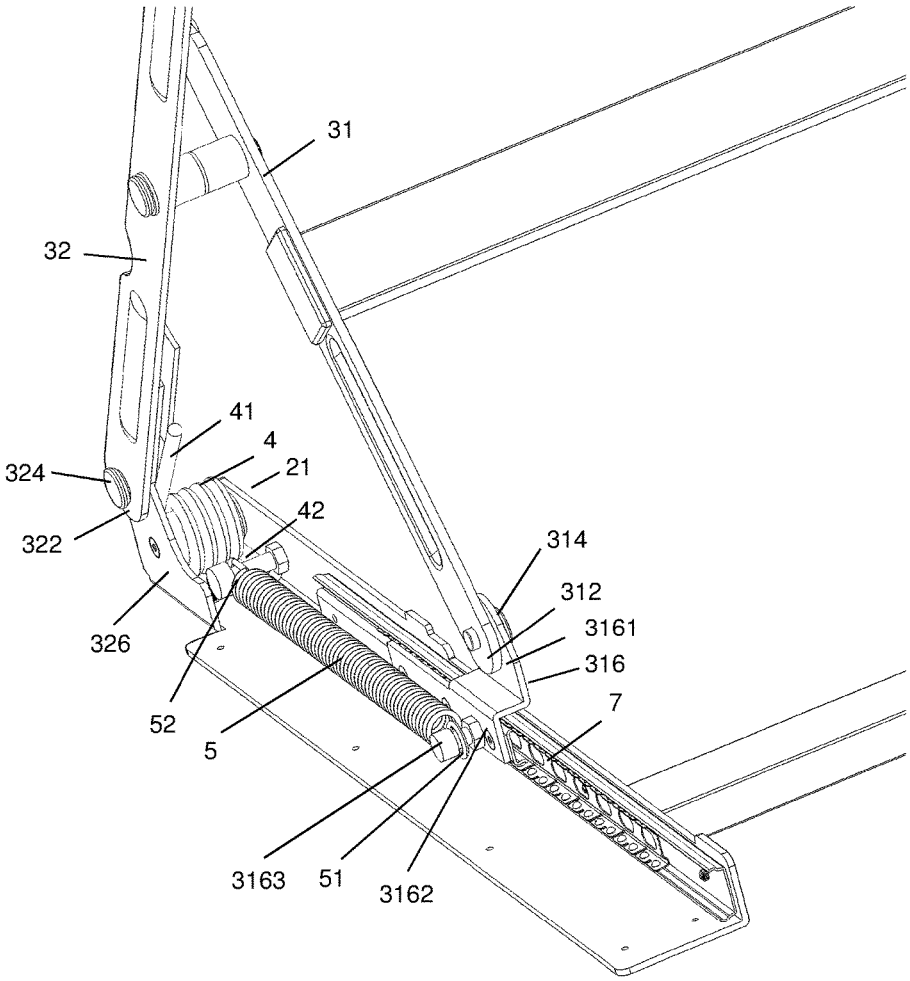
FIG. 3 is a partial perspective view of one of the pair of base supports of the preferred embodiment as shown in FIG. 1 with some parts removed for better illustration of the first biasing means and the second biasing means.
Figure 4:
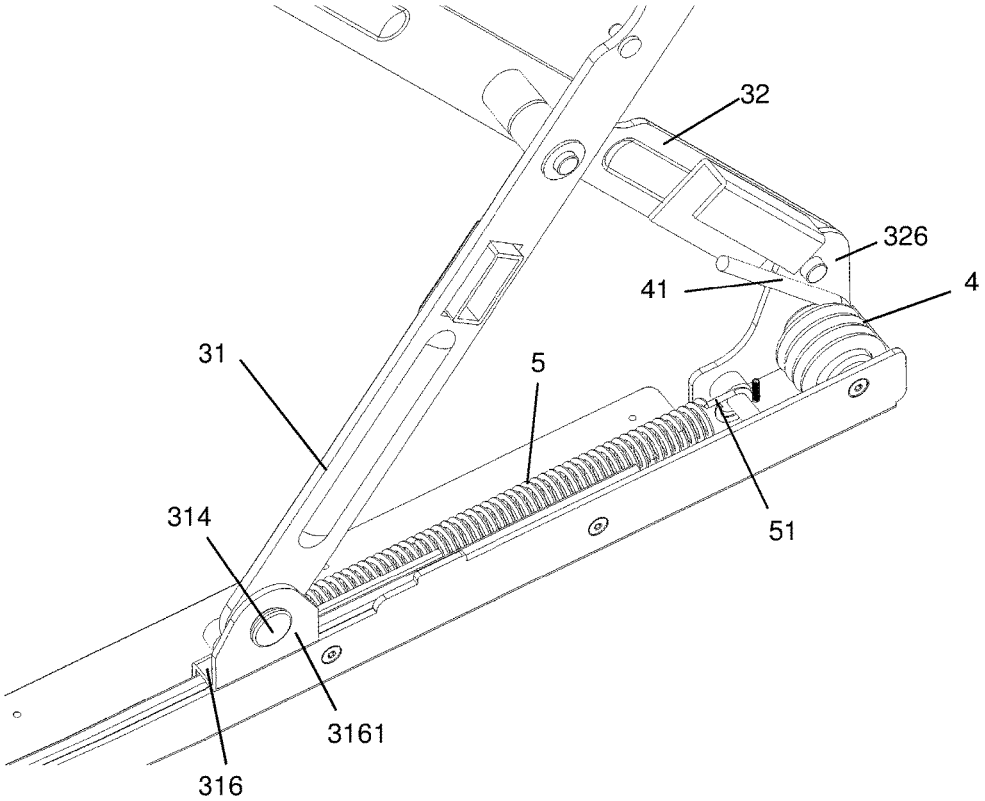
FIG. 4 is another partial perspective view of one of the pair of base supports of the preferred embodiment as shown in FIG. 1 with some parts removed for better illustration of the first biasing means and the second biasing means.
Figure 5:
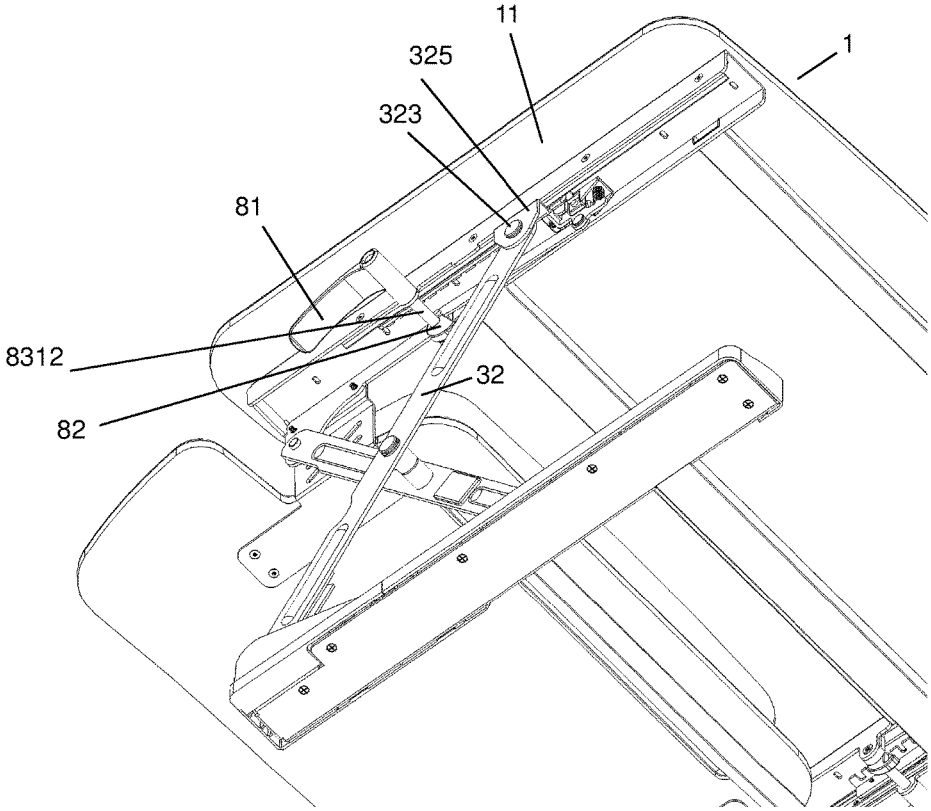
FIG. 5 is a partial perspective view illustrating one of the pair of height adjustment means of the preferred embodiment as shown in FIG. 1.
Figure 6:
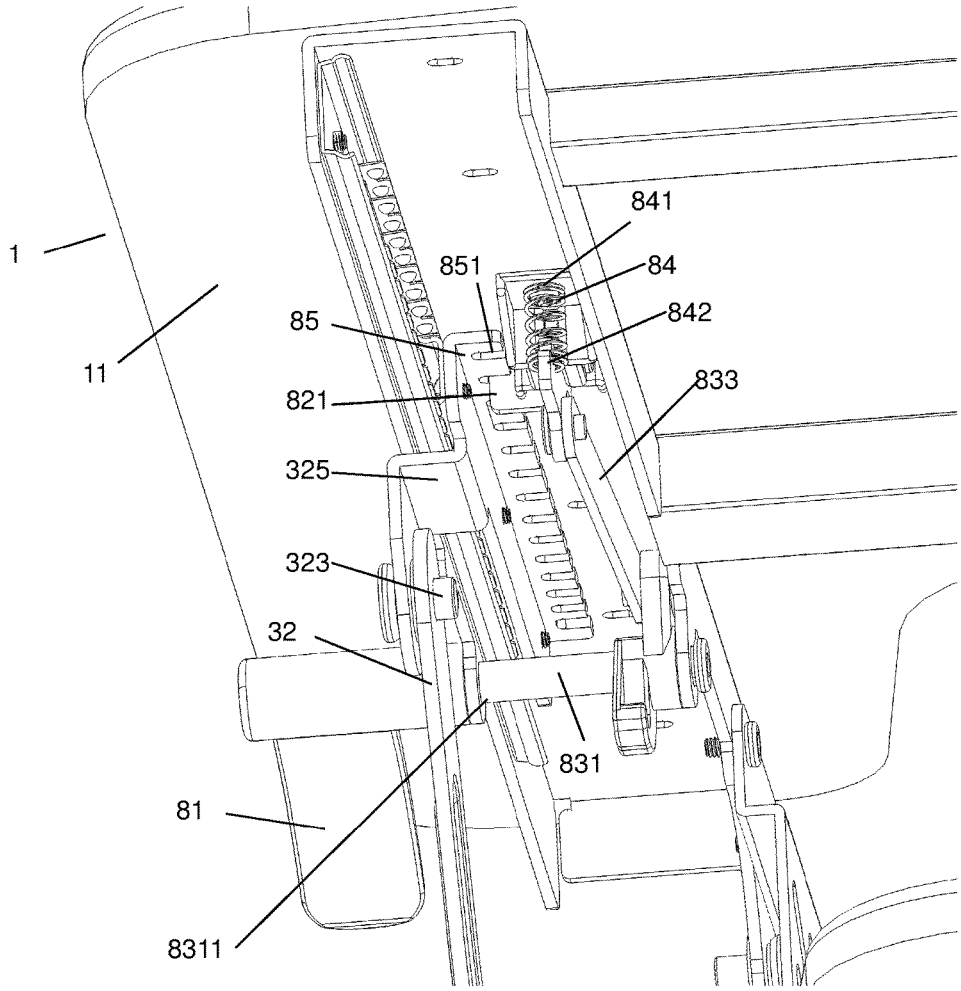
FIG. 6 is another partial perspective view illustrating one of the pair of height adjustment means of the preferred embodiment as shown in FIG. 1.

The present invention is further described in detail with the following embodiment and the accompanying drawings.

As illustrated in FIGS. 1-7, a preferred embodiment of the height adjustable desk comprises a desktop 1, a pair of base supports 2 and a pair of X-shaped frames 3. The pair of X-shaped frames 3 engages the desktop 1 with the pair of base supports 2. The desktop 1 is adjustable between a fully raised position and a fully lowered position.

The pair of X-shaped frames 3 each has a first arm 31 and a second arm 32. Each of the first arms 31 has a first top end 311 and a first bottom end 312, wherein the first top end 311 is pivotally connected to a top front pivot point 313 fixedly connected to the desktop 1 via a first upper bracket 315, and the first bottom end 312 is pivotally connected to a bottom rear pivot point 314 movably connected to the corresponding base support 2 via a first lower bracket 316. Each of the second arms 32 has a second top end 321 and a second bottom end 322, wherein the second top end 321 is pivotally connected to a top rear pivot point 323 movably connected to the desktop 1 via a second upper bracket 325, and the second bottom end 322 is pivotally connected to a bottom front pivot point 324 fixedly connected to the corresponding base support 2 via a second lower bracket 326.

Each of the pair of base supports 2 has a first biasing means 4 and a second biasing means 5. In this embodiment, the first biasing means 4 is in form of a torsion spring with a first leg and a second leg which respectively serve as a first end 41 and a second end 42 of the first biasing means 4, wherein the first end 41 engages the second bottom end 322 of the corresponding second arm 32 and the second end 42 engages a front end 21 of the corresponding base support 2 by abutting against an inner side of the first lower bracket 326; the first biasing means 4 is configured to bias the corresponding second arm 32 upwards to move the desktop 1 towards the fully raised position. In this embodiment, the second biasing means 5 is in form of a coil spring having a first end 51 which engages the first bottom end 312 of the corresponding first arm 31 via the corresponding first lower bracket 316 and a second end 52 which engages the corresponding base support 2 at a position near the front end 21 of the corresponding base support 2; the second biasing means 5 is configured to bias the corresponding first arm 31 upwards to move the desktop 1 towards the fully raised position.

Each of the first lower brackets 316 provided at a lower end of each of the first arms 31 slides along a lower guide rail 7 extending along the corresponding base support 2. Each of the first lower brackets 316 has an upper portion 3161 and a lower portion 3162; the first bottom end 312 of the corresponding first arm 31 is pivotally connected to the corresponding upper portion 3161 at the corresponding bottom rear pivot point 314; the lower portion 3162 is provided with a protrusion 3163 by which the first end 51 of the corresponding second biasing means 5 engages the first bottom end 312 of the corresponding first arm 31.

During operation, when the user exerts a downward force to push the desktop 1 downward from the fully raised position to the fully lowered position, the first ends 41 of the first biasing means 4 are compressed, and the first lower brackets 316 are forced to slide rearward along the lower guide rails 7 and thus forces the second biasing means 5 to extend and enter a stressed state. When the user lifts the desktop 1 upwards, the first ends 41 of the first biasing means 4 are urged to return to their uncompressed state, thus providing an uplifting force which facilitates uplifting of the desktop 1; furthermore, the second biasing means 5 are also urged to contract and return to their relaxed state, thus providing a pull force to pull the first lower brackets 316 forward, thus facilitating uplifting of the desktop 1. The actions of the first biasing means 4 and the second biasing means 5 help to reduce the force required by the user to lift up the desktop 1.

An underside 11 of the desktop 1 is provided with a pair of height adjustment means 8. The pair of height adjustment means 8 each comprises a handle 81, a connecting piece 82, a linkage mechanism 83, a biasing member 84 and a guiding member 85. Each of the handles 81 is rotatable between an upward position and a downward position. Each of the guiding members 85 is provided with a plurality of slots 851 and is fixedly connected to the corresponding top rear pivot point 323 via the corresponding second upper bracket 325, and is movable in relation to the desktop 1 along an upper guide rail 9 fixedly provided at the underside of the desktop 1 as the desktop 1 is moved between the fully raised position and the fully lowered position. Each of the connecting pieces 82 is connected to the corresponding handle 81 via a linkage mechanism 83 so that rotation of the corresponding handle 81 to the upward position moves the connecting piece 82 to an unlocking position and rotation of the corresponding handle 81 to the downward position moves the connecting piece 82 to a locking position. Each of the connecting pieces 82 is provided with a laterally extended tab portion 821 which is configured to fit into any of the plurality of slots 851 of the corresponding guiding member 85 in the locking position so as to fix the position of the desktop 1 in relation to the pair of base supports 2. Each of the biasing members 84 biases the corresponding connecting piece 82 towards the locking position. In the present embodiment, each of the biasing members 84 is in form of a spring with a first end 841 abutting against the underside 11 of the desktop 1 and a second end 842 abutting against the corresponding connecting member 82.

Each of the linkage mechanisms 83 comprises a rotating rod 831, a first linkage member 832 and a second linkage arm 833. Each of the rotating rods 831 has a first end 8311 rotatably connected to the corresponding handle 81. Each of the first linkage members 832 has a first end 8321 which is rotatable by a second end 8312 of the corresponding rotating rod 831. Each of the second linkage arms 833 has a first end 8331 which is pivotably connected to a second end 8322 of the corresponding first linkage member 832 and a second end 8332 which is pivotably connected to the corresponding connecting piece 82.

Figure 7:
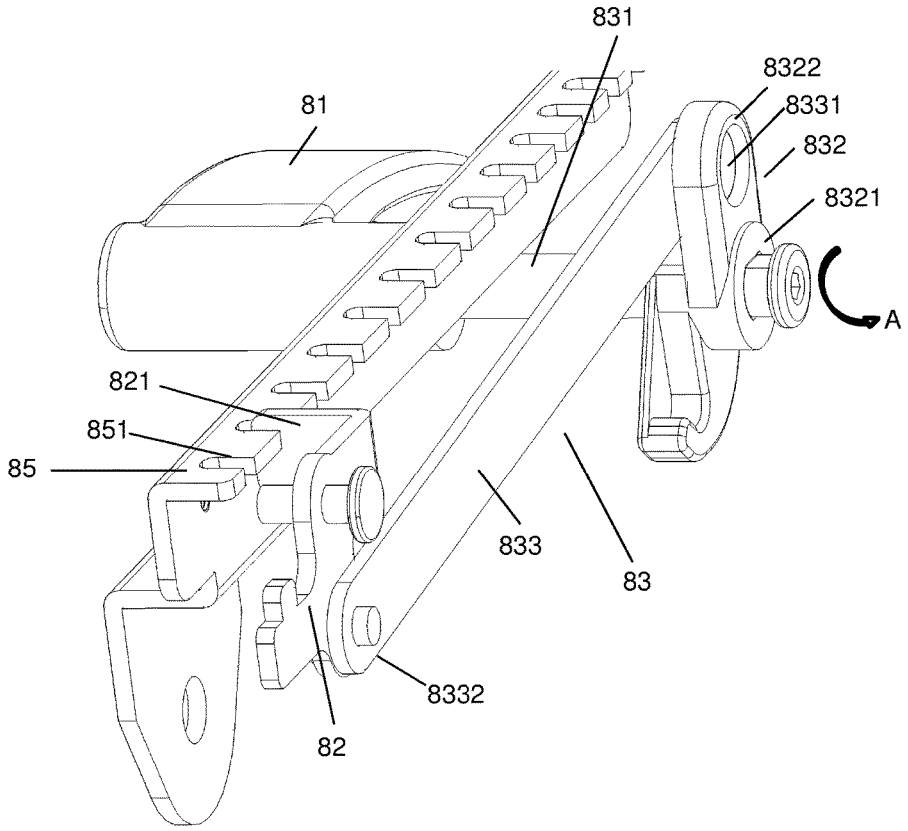
FIG. 7 is another partial perspective view illustrating one of the pair of height adjustment means of the preferred embodiment as shown in FIG. 1 with some parts removed for better illustration.

During operation, when the user wishes to adjust the position of the desktop 1, the user simultaneously rotates the two handles 81 to the upward position, thereby drives rotation of the first linkage members 831 around the rotating rods 832 along a first direction (as indicated by the arrow A in FIG. 7) to rotate the first ends 8331 of the second linkage arms 833 from a vertical position (as shown in FIG. 7) to a horizontal position; the second ends 8332 of the second linkage arms 833 are thereby driven to move downwards and causes the connecting pieces 82 to overcome biasing force exerted by the biasing members 84 to move downward to the unlocking position. The tab portions 821 of the connecting pieces 82 thus no longer snap into any of the slots 851 of the guiding members 85, and the guiding members 85 are freely movable along the upper guide rails 9 to move the desktop 1 between the fully raised position and the fully lowered position. The plurality of slots 851 provided in each of the guiding members 85 allows the user to fix the desktop 1 at a corresponding number of positions between the fully raised position and the fully lowered position.

The present embodiment further comprises a keyboard tray 10 which is fixedly engaged with the desktop 1 so that adjusting the height of the desktop 1 also results in the same adjustment of the height of the keyboard tray 10. An reinforcing bar 101 fixedly connects the first arms 31 of the pair of X-shaped frames 3 to improve rigidity of the desk. Covers 102 are provided at the pair of base supports 2 to conceal the first biasing means 4 and the second biasing means 5. The aforementioned structures are obvious to those skilled in the art and are therefore not detailed herein.

The pair of X-shaped frames 3 and the pair of height adjustment means 8 of the present invention are simple in structure, easy to manufacture and assemble and low in costs. The pair of X-shaped frames 3 reduces the force required by the user to lift up the desktop 1. The pair of height adjustment means 8 provides a convenient means for user to adjust the desktop 1 to various heights.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A height adjustable desk comprising a desktop which engages with a pair of base supports by a pair of X-shaped frames and is adjustable between a fully raised position and a fully lowered position;

the pair of X-shaped frames each comprises a first arm having a first top end and a first bottom end, wherein the first top end is pivotally connected to a top front pivot point fixedly connected to the desktop, and the first bottom end is pivotally connected to a bottom rear pivot point movably connected to the corresponding base support; and a second arm having a second top end and a second bottom end, wherein the second top end is pivotally connected to a top rear pivot point movably connected to the desktop, and the second bottom end is pivotally connected to a bottom front pivot point fixedly connected to the corresponding base support;

the pair of base supports each comprises a first biasing means having a first end which engages the second bottom end of the corresponding second arm and a second end which engages a front end of the corresponding base support; the first biasing means is configured to bias the corresponding second arm upwards to move the desktop towards the fully raised position; and a second biasing means having a first end which engages the first bottom end of the corresponding first arm and a second end which engages the corresponding base support; the second biasing means is configured to bias the corresponding first arm upwards to move the desktop towards the fully raised position;

a pair of height adjustment means is provided on an underside of the desktop, each of which comprises:

a handle rotatable between an upward position and a downward position;

a guiding member provided with a plurality of slots and fixedly connected to the corresponding top rear pivot point is movable in relation to the desktop along an upper guide rail as the desktop is moved between the fully raised position and the fully lowered position;

a connecting piece connected to the handle via a linkage mechanism so that rotation of the handle to the upward position moves the connecting piece to an unlocking position and rotation of the handle to the downward position moves the connecting piece to a locking position; the connecting piece is provided with a laterally extended tab portion which is configured to fit into any of the plurality of slots of the guide member in the locking position so as to fix the position of the desktop in relation to the pair of base supports; and a biasing member which biases the connecting piece towards the locking position;

each of the linkage mechanism comprises a rotating rod having a first end rotatably connected to the corresponding handle;

a first linkage member having a first end which is rotatable by a second end of the rotating rod; and a second linkage arm having a first end which is pivotably connected to a second end of the first linkage member and a second end which is pivotably connected to the corresponding connecting piece;

simultaneous rotation of the handles to the upward position drives rotation of the first linkage members around the rotating rods along a first direction and thereby rotates the first ends of the second linkage arms from a vertical position to a horizontal position; the second ends of the second linkage arms are thereby driven to move downwards and causes the connecting pieces to overcome biasing force exerted by the biasing members to move downward to the unlocking position.

2. The height adjustable desk as in claim 1, wherein each of the first biasing means is in form of a torsion spring with a first leg engaging the second bottom end of the corresponding second arm and a second leg abutting against an inner side of the corresponding base support.

3. The height adjustable desk as in claim 1, wherein each of the second biasing means is in form of a coil spring with the second end thereof engaging the corresponding base support at a position near the front end of the corresponding base support.

4. The height adjustable desk as in claim 1, wherein a first lower bracket is provided at a lower end of each of the first arms and slides along a lower guide rail extending along the corresponding base support; each of the first lower brackets has an upper portion and a lower portion; the first bottom end of the corresponding first arm is pivotally connected to the corresponding upper portion at the corresponding bottom rear pivot point; the lower portion is provided with a protrusion by which the first end of the corresponding second biasing means engages the first bottom end of the corresponding first arm.

5. The height adjustable desk as in claim 4, wherein each of the bottom rear pivot points is movably connected to the corresponding base support via the first lower bracket.

6. The height adjustable desk as in claim 5, wherein each of the bottom front pivot points is fixedly connected to the corresponding base support via a second lower bracket.

7. The height adjustable desk as in claim 1, wherein each of the biasing members is in form of a spring with a first end abutting against the underside of the desktop and a second end abutting against the corresponding connecting member.

8. The height adjustable desk as in claim 1, wherein each of the top front pivot points is fixedly connected to the desktop via a first upper bracket.

9. The height adjustable desk as in claim 8, wherein each of the top rear pivot points is movably connected to the desktop via a second upper bracket.

* * * * *